United States Patent [19]

Barlow et al.

[11] 3,997,156

[45] Dec. 14, 1976

[54] MAGIC HAT

[75] Inventors: Gordon A. Barlow, Skokie; John R. Wildman, Hanover Park, both of Ill.

[73] Assignee: Marvin Glass & Associates, Chicago, Ill.

[22] Filed: Jan. 22, 1975

[21] Appl. No.: 542,954

[52] U.S. Cl. ..... 272/8 R; 2/175; 272/25

[51] Int. Cl.[2] ..... A63J 21/00

[58] Field of Search ..... 272/25, 8 R, 8 D, 8 F, 272/8 M, 8 N, 8 P, 272 R, 272 B, 272 N, 272 W; 46/1 F; 2/175, 185 R, 185 B, 185 C, 3 R, 3 A, 3 B, 3 C, 189, 190, 195, 196; 215/6; 206/8; 220/16, 20, 22

[56] References Cited

UNITED STATES PATENTS

| | | | |
|---|---|---|---|
| 441,805 | 12/1890 | Parker | 2/190 UX |
| 770,031 | 9/1904 | Werrick | 2/185 R UX |
| 1,063,565 | 6/1913 | McCord | 2/185 R |
| 1,628,189 | 5/1927 | Raisner | 272/8 N UX |
| 1,635,916 | 7/1927 | Williams | 2/185 R |
| 1,762,501 | 6/1930 | Brehmer | 272/8 N |
| 1,775,747 | 9/1930 | Ake | 272/8 R |
| 2,129,981 | 9/1938 | Alva | 272/8 R |
| 2,209,609 | 7/1940 | Odom | 2/175 X |
| 2,471,676 | 5/1949 | Enochs | 272/8 R |
| 2,593,188 | 4/1952 | Rickelman | 272/27 N X |
| 3,134,983 | 6/1964 | Lipkin | 2/195 |
| 3,217,928 | 11/1965 | Burbig | 272/27 R X |

FOREIGN PATENTS OR APPLICATIONS

| | | | |
|---|---|---|---|
| 427,538 | 5/1911 | France | 2/185 R |
| 116,369 | 6/1918 | United Kingdom | 215/6 |

*Primary Examiner*—Anton O. Oechsle
*Assistant Examiner*—Arnold W. Kramer

[57] ABSTRACT

A magic hat for aiding a magician in performing magic tricks or illusions. The magic hat includes a generally cylindrical portion with a rim secured to one end and a closure plate covering the other end. A plurality of internal cavities are provided to facilitate performing various illusions. One cavity provides a fluid reservoir for storage of a fluid (i.e., water) which is poured directly into the hat and holding the fluid when the hat is inverted. A second cavity provides a concealed storage area for a set of playing cards and/or a flag or other suitable cloth. A third cavity longitudinally along the cylindrical wall of the hat provides a storage area for a magic wand and mounts a second, flexible, fluid reservoir. A pair of apertures are provided in the side walls of the cylindrical portion of the hat adjacent its rim to provide access to the magic wand and to permit squeezing of the flexible reservoir to expel a stream of water through the top of the hat. An elastic fabric band is mounted over the apertures to conceal and disguise their presence. An elastic string or wire is provided to perform illusory movements of the magic hat.

11 Claims, 15 Drawing Figures

Fig 5
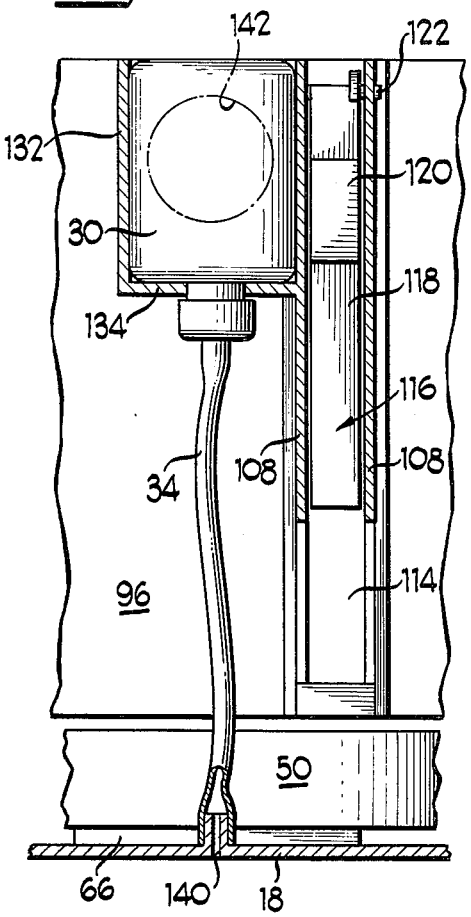
Fig 6
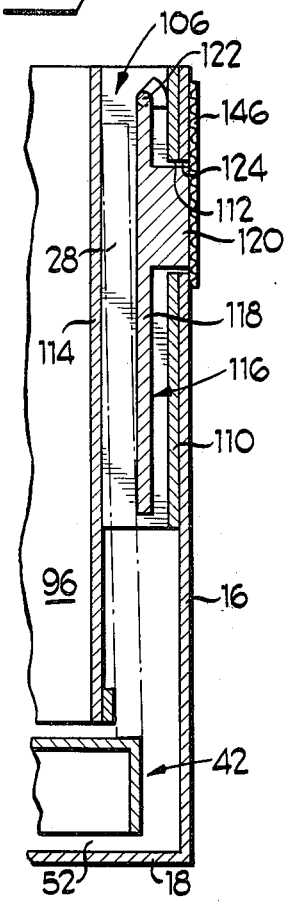
Fig 7
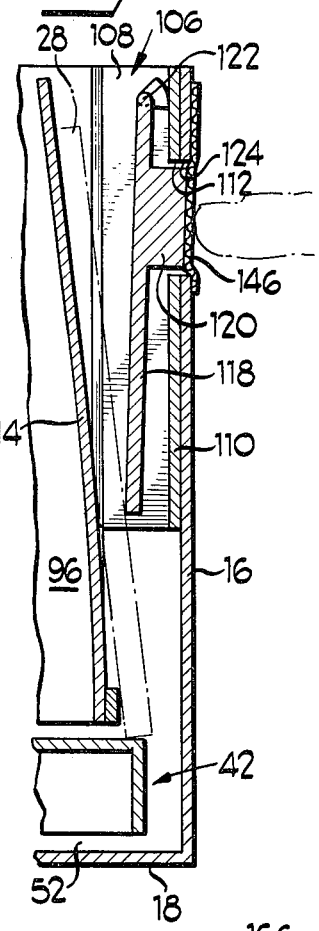
Fig 8
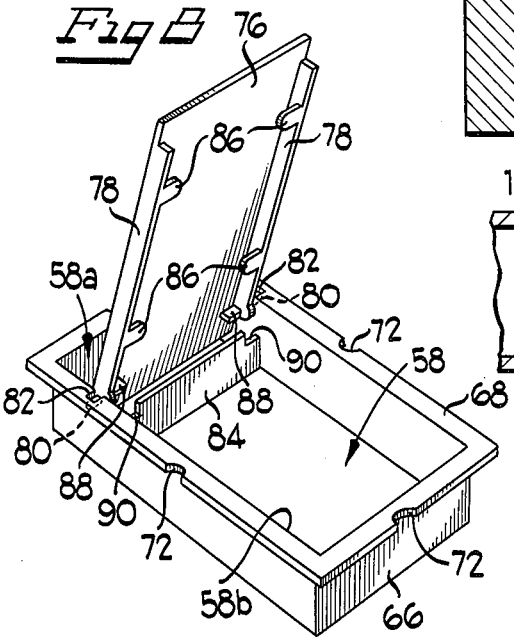
Fig 9
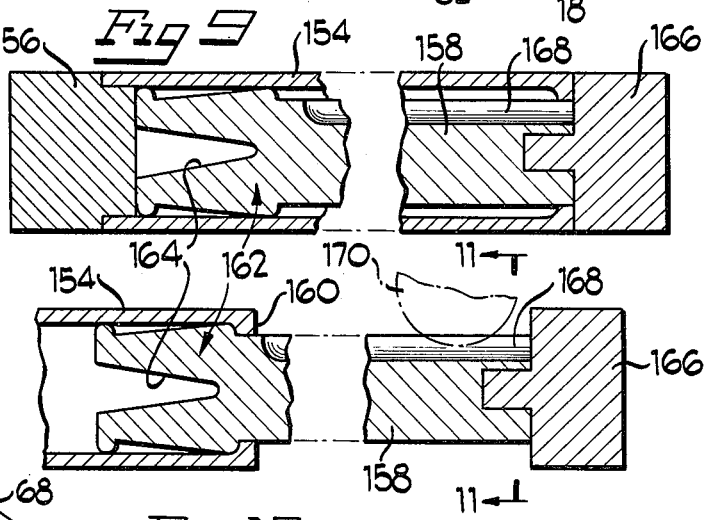
Fig 10
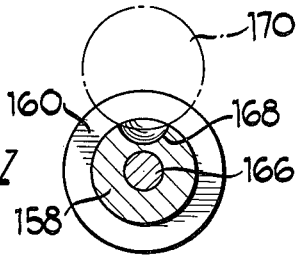
Fig 11

MAGIC HAT

BACKGROUND OF THE INVENTION

In the past, many devices have been proposed to aid a professional or amateur magician in performing magic "tricks." Many of these devices have been well received, especially among amateur magicians, because they enable the performer to present illusions to the audience without requiring the great degree of skill achieved by professionals. Some of these devices included, for example, decks of cards wherein some of the cards were "shaved"to permit easy location of a particular card by the performer. Others have been in the form of a magician's hat which have included a hidden compartment for concealment of the traditional rabbit or dove which the magician miraculously "pulls" out of the hat.

An object of the present invention is to provide a new and improved magic hat having a plurality of concealed inner compartments for the storage of trick accessories.

In accordance with the above, the present invention includes a magic hat having a tall upper compartment which is closed at one end and carries a rim or brim at the other end. A fluid reservoir cavity is formed by a plurality of baffle means in the uppermost end. A storage compartment is mounted within the fluid reservoir cavity, flush with the baffle means for storing a plurality of cards and/or a flag or scarf which can be pulled from the hat. A crescent shaped longitudinal cavity is provided along the interior of one side of the hat for storing a "magic wand" and also forms a second fluid reservoir. Access holes to the crescent cavity are provided on the exterior of the hat and disguised or hidden by a wide band of flexible or fabric material. An elastic string is provided about the band to enable the performer to cause the hat to mysteriously slide across a table while waving the wand above the hat and tugging on a portion of the elastic string.

BRIEF DESCRIPTION OF THE DRAWINGS

FIG. 5 is a vertical section taken generally along the line 5—5 of FIG. 4;

FIG. 6 is a vertical section taken generally along the line 6—6 of FIG. 4;

FIG. 7 is a vertical section similar to that of FIG. 6, showing the actuating button depressed for access to the wand;

FIG. 8 is a perspective view of the hidden compartment within the magic hat at the closed end thereof;

FIG. 9 is a fragmented vertical section of the magic wand shown in its non-telescoped position;

FIG. 10 is a fragmented vertical section, similar to FIG. 9, of the wand, showing the wand in its telescoped position supporting a ball;

FIG. 11 is a vertical section of the telescoped portion of the wand taken generally along the line 11—11 of FIG. 10;

DESCRIPTION OF THE PREFERRED EMBODIMENT

Figure 1:
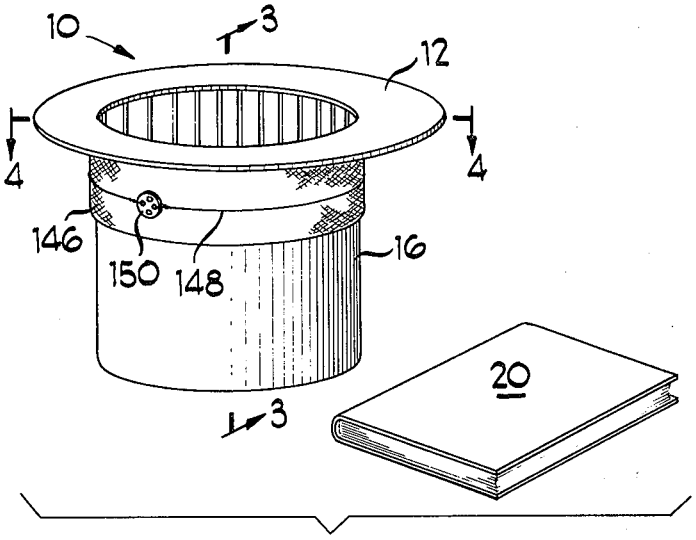
FIG. 1 is a perspective view of the magic hat and instruction booklet of the present invention.

A magic hat, generally designated 10, is shown in FIG. 1 in an upsidedown or overturned position. The hat 10 includes an annular rim or brim 12 which is mounted on the bottom of a hollow cylindrical housing 16. A circular cap, generally designated 18 (FIGS. 3 and 12), closes the top end of the housing 16. An instruction booklet 20 is included with the magic hat 10 to illustrate to the user a plurality of different magic tricks which may be performed with the hat 10.

Figure 2:
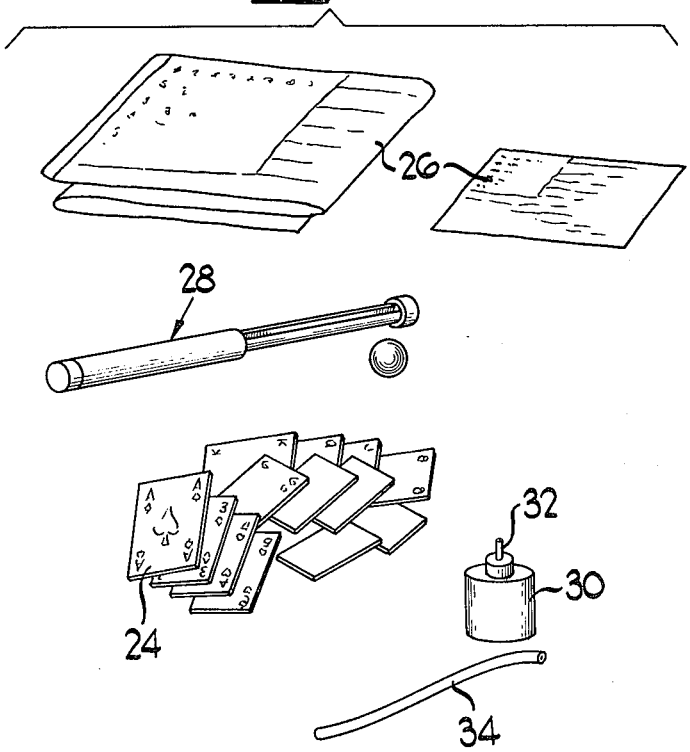
FIG. 2 is a perspective view of a deck of cards, a fluid reservoir and communication hose, a magic wand and ball, and a flag in a folded condition and, on a reduced scale, in an unfolded position, all incorporated with the magic hat of the present invention.

A plurality of accessory items are shown in FIG. 2 for use with the hat 10. The accessory items include a set of playing cards 24, a flag 26, a magic wand, generally designated 28, and a flexible fluid reservoir 30. The fluid reservoir 30 includes a nozzle 32 which is connected to a flexible hose 34 for use with the hat 10, as will be described in detail hereinafter. A plurality of magic tricks or illusions can be performed with the use of the hat 10, alone, or in combination with one of the accessories shown in FIG. 2.

Figure 3:
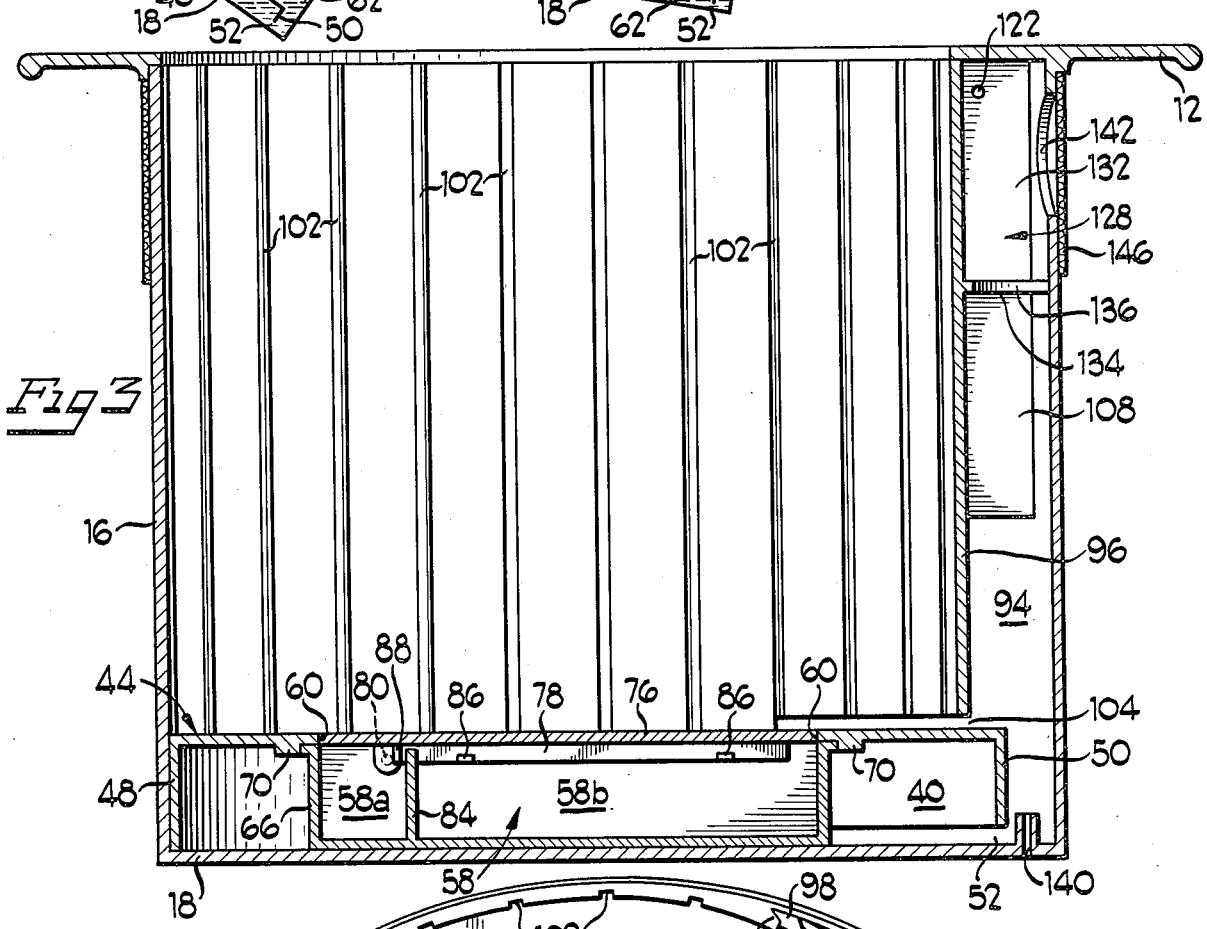
FIG. 3 is a vertical section, on an enlarged scale, taken generally along the line 3—3 of FIG. 1.

One of the plurality of magic tricks which may be performed with the present invention includes a trick in which water or other fluid is poured directly into the hat, after which the hat is overturned and placed on the head of the magician without spilling any of the water or other fluid. For this trick, a water-tight fluid reservoir or cavity 40 (FIG. 3) is formed in the top end of the housing 16 inside the cap 18. Baffle means in the shape of an inverted dish, generally designated 42 (FIG. 13), is mounted within the housing 16 adjacent the cap 18 to form the cavity 40. More particularly, the baffle 42 includes a generally circular disc portion 44 which substantially fills the interior area of the housing 16. A web or skirt portion 48 is formed on the disc 44 around approximately 80 percent of the disc 44 and engages the side walls of the housing 16 and the inner surface of the cap 18. A shorter semi-circular skirt portion 50 is formed around the remaining periphery of the disc 44 to form the cavity 40. The skirt portion 50, as seen in FIG. 3, is spaced from the cap 18 to provide an access opening 52 for fluid to enter the cavity 40. The radius of the smaller skirt portion 50 is slightly larger than that of the skirt portion 48 and includes two offset webs 54 to conform to the internal shape of the housing 16. The internal shape of the housing and the reasons therefore will be described in detail with respect to the additional magic tricks.

A water-tight pocket or second cavity 58 (FIG. 3) is formed within a rectangular aperture 60 formed in the disc 44 as will be described in detail below.

Figure 12A:
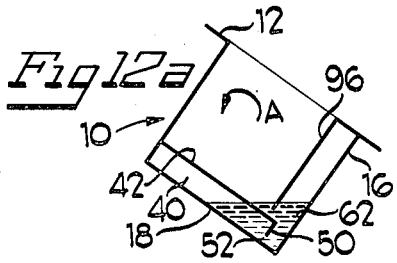
FIGS. 12*a*, *b* and *c* are sequential views showing the retention of a fluid in the upper fluid reservoir by rotation of the magic hat.
Figure 12B:
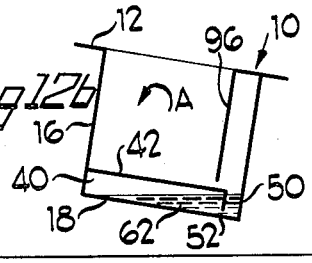
Figure 12C:
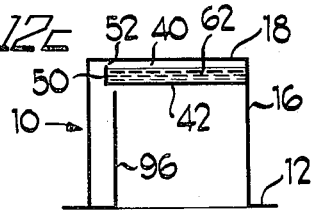

Referring to FIGS. 12*a* through 12*c*, the steps necessary to perform the illusion of pouring water into the hat and then inverting the hat onto the performer's head are shown in sequence. The performer first pours a given quantity of liquid 62 (FIGS. 12*a*) into the hat while tilting the hat as shown to cause the fluid to flow through the aperture 52 into the cavity 40. The hat then is rotated in a counterclockwise direction, as shown by arrow A in FIG. 12*a*. The hat 10 is rotated through the position as shown in FIG. 12*b* to the final position as shown in FIG. 12*c* where the hat can be worn in the upright position on the performer's head without any of the fluid 62 seeping out. To remove the fluid 62 from the hat, the reverse process is performed which permits the fluid 62 to be poured from the hat 10.

The cavity 58, previously referred to, is provided for storing the deck of cards 24 and the flag 26. More particularly, referring to FIGS. 8 and 13, the cavity includes a generally rectangular box portion 66 which is mounted in the top of the disc 44 within the cavity 40. The rectangular box 66 includes a flange 68 therearound which fits within a corresponding rectangular ridge or boss 70 (FIG. 3) formed on the upper side of the disc 44. Detent means in the form of notches 72 on the flange 68 and tabs (not shown) in the boss 70 insure proper placement of the rectangular box 66 on the disc 44. A suitable adhesive is used between the contact areas of the flange 68 and the boss 70 to provide a water-tight seal within the cavity 40. The cavity 58 is provided with a pivotally mounted lid 76 to conceal the items 24 and 26 within the cavity 58. The lid 76 includes a pair of parallel flanges 78 and a pivot pin 80 on each flange 78. The pivot pins 80 are mounted within a pair of journal recesses 82 formed in either side of the rectangular box 66. Two compartments **58*a* and 58*b* are formed within the rectangular box 66 by an upstanding interior flange 84. The smaller compartment 58*a* formed behind the flange 84 provides clearance for the end of the lid 76 behind the pivot pins 80. The compartment 58*b* provides space for storing of the flag 26**.

Referring to FIG. 8, four inwardly directed tabs 86 are provided on the flanges 78 beneath lid 76 to maintain the cards 24 in a position thereunder. Two inwardly directed tabs 88 are provided near the pivot pins 80 to prevent the cards from interfering with the flange 84 during closure. A pair of rectangular cutouts 90 are provided on the flange 84 to permit clearance for the tabs 88. In use, the lid 76 is flush with the disc 44 so that the hat will appear to be empty to the audience. The overhanging portion of the lid behind the pivot pins permits the lid 76 to be opened merely by depressing the portion of the lid behind the pivot pins 80 to gain access to either the cards or the flag.

Figure 13:
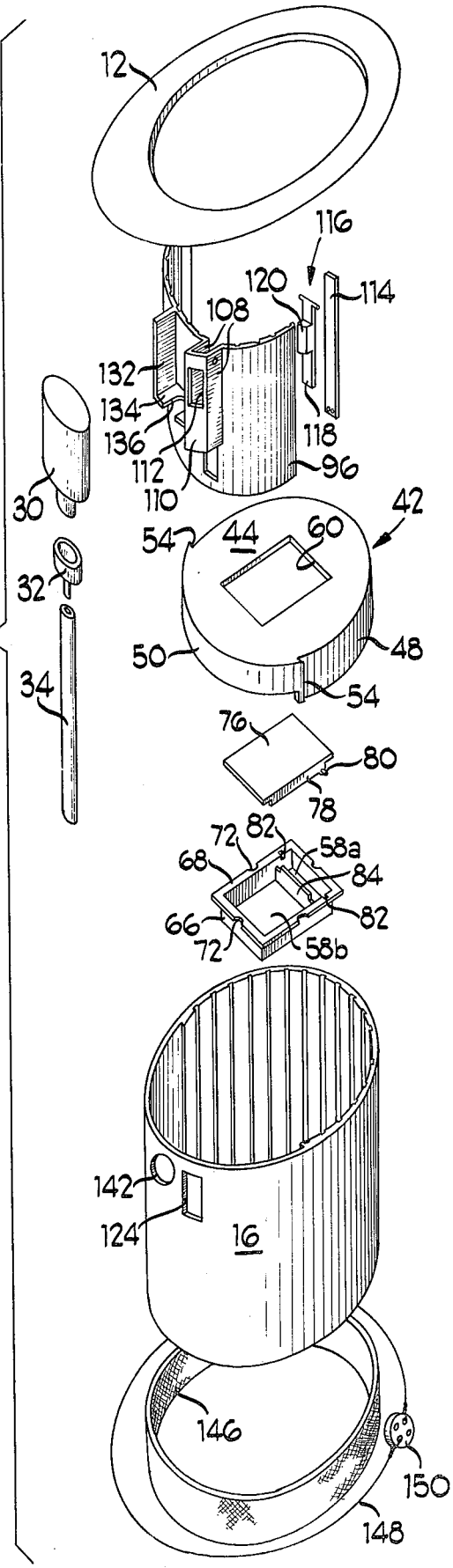
FIG. 13 is an exploded perspective view of the components of the magic hat of the present invention.
Figure 4:
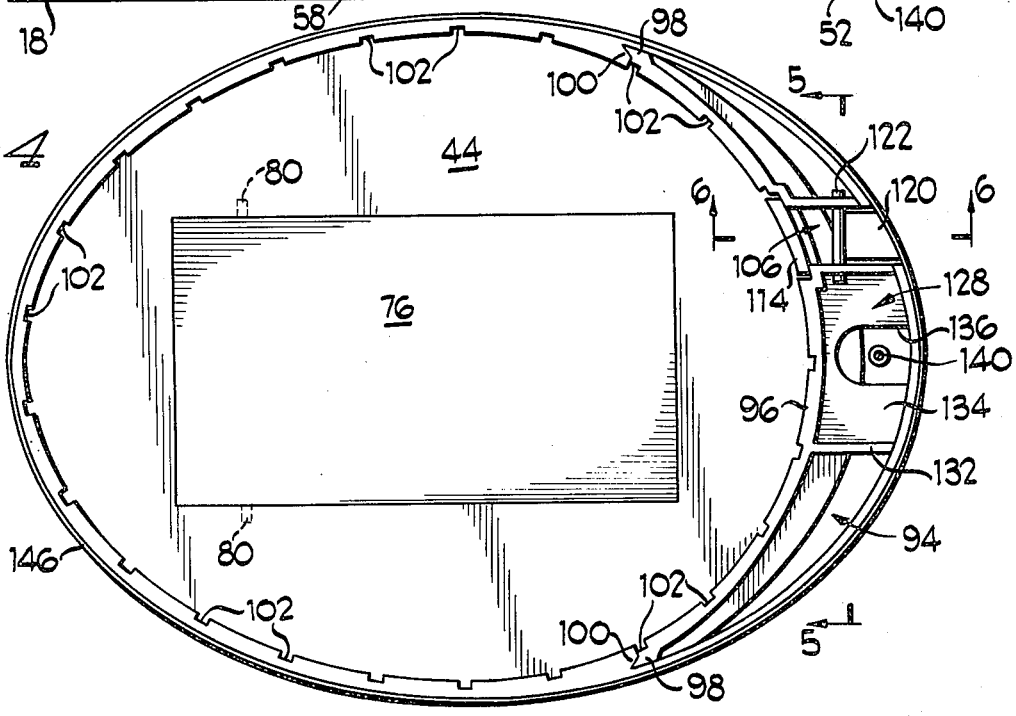
FIG. 4 is a horizontal section, on an enlarged scale, taken generally along the line 4—4 of FIG. 1.

A third, crescent-shaped longitudinal cavity, generally designated 94, is formed along the interior of the wall of the housing 16. Referring to FIGS. 4 and 13, the cavity 94 is formed between the inner wall of the housing 16 and a semi-circular shell portion 96 of slightly larger diameter than that of the housing 16. The shell 96 includes two tapered ends 98 which engage a pair of complementary recesses 100 formed in the housing 16. The inside surface of the shell 96 and the inside portion of the interior of the housing which is not covered by the shell 96 includes a plurality of vertical notches or grooves 102, rectangular in cross section, along the entire length thereof. The main purpose of the notches 102 is to disguise or conceal the juncture between the shell 96 and the housing 16. As seen in FIG. 4, one wall of the notch 102 adjacent either end of the shell 96 is formed in the housing 16 while the other two walls thereof are formed in the shell 96 itself. Therefore, to the casual observer, after assembly, it is not possible to see a juncture between the ends of the shell 96 and the housing 16.

The shell 96 itself extends substantially the entire length of the housing, but terminates just short of the disc 44 to provide an opening 104 therebetween to allow passage of fluid to perform the first trick previously described.

The cavity thus formed behind the shell 96 is further divided into two compartments, one for storage of the magic wand 28, and the other for storage of the flexible fluid reservoir 30 and hose 34. More particularly, referring to FIGS. 4 through 7 and 13, a magic wand compartment, generally designated 106, is formed between two rearwardly directed flanges 108 on the shell 96 (FIG. 13). A back wall 110 is formed across the flanges 108 including a rectangular opening 112 for access into the wand compartment 106. The front or inside portion of the wand compartment 106 is substantially open and is covered by a flexible resilient member 114 which is secured at the uppermost end of the shell 96. A wand ejector member, generally designated 116, is pivotally mounted within the wand compartment 106. The ejector comprises an elongated tab 118 and a rectangular button 120 formed integrally therewith which extends into the aperture 112. The tab 118 is pivotally mounted between the two flanges 108 by a pivot pin 122. Referring to FIG. 6, the magic wand 28 is shown in phantom within the wand compartment 106. The aperture 112 is in alignment with an aperture 124 formed within the housing 16 to provide access to the button 120. As the button 120 is pressed (FIG. 7), the ejector 116 pivots into engagement with the wand 28 thereby flexing the cover 114 to permit access to the wand 28. Thus, without any visible compartments, a magician or performer can provide an illusion by pulling a wand from the hat.

Adjacent the wand cavity 106 is a fluid reservoir cavity, generally designated 128 (FIG. 5). The cavity 128 is formed between one of the flanges 108 and a third vertical flange 132. The bottom of the fluid reservoir cavity 128 is formed by a horizontal flange 134 which contains a U-shaped cut-out 136 for passage of the nozzle 32 of the fluid reservoir 30. The reservoir neck 32 is in communication with an aperture 140 formed in the cap 18 by the hose 34. The fluid reservoir 30, when the magic hat 10 is assembled, is adjacent a circular aperture 142 formed in the housing 16. The magician or performer can then depress the flexible reservoir 30 and cause a "squirt" of water to emerge from the cap 18 of the hat.

A flexible fabric band 146 is provided to surround the housing adjacent the brim 12 and thereby disguise the apertures 124 and 142 while still permitting manual manipulation thereof by the performer.

An elastic string 148 surrounds the flexible fabric band 146 and includes a button 150 to perform a type of levitation trick. The button 150 provides a convenient place for the performer to hold the string 148 and stretch it by pulling the hat toward himself, while waving the magic wand 28 above the hat to distract the audience, the "magician" can cause the hat 10 to mysteriously slide across a table or other suitable supporting surface.

Referring to FIGS. 9–11, the magic wand 28 includes a hollow tubular portion 154 which is closed by a cap 156 on one end (FIG. 9). A solid telescoping portion 158 fits within the tubular portion 154. The tubular portion has a crimped edge 160 around its open end and the solid telescoping portion 158 includes a head, generally designated 162, which cannot pass the crimped edge 160. The head 162 includes a V-shaped cutout 164 which permits easy snap-in assembly of the telescoping portion 158. The free end of the telescoping portion 158 includes a cap 166 which is the same diameter as the outside of the tubular portion 154 to disguise the telescoping feature when in a closed position. The solid portion 158 includes a U-shaped trough 168 which is not easily visible to the audience. The trough 168 when positioned on the upper side of the wand enables the magician to mysteriously "balance" a ball 170 on top of the wand when placed in the trough 168.

The foregoing detailed description has been given for clearness of understanding only and no unnecessary limitations should be understood therefrom as some modifications will be obvious to those skilled in the art.

We claim:

1. A hat, comprising:

a generally cylindrical housing defining the main body of the hat and having an end wall closing one end of the cylindrical housing;

means defining a hidden cavity extending longitudinally along a portion of the inside of said housing, said means including a longitudinally extending arcuate shell of a larger diameter than that of the cylindrical housing and spaced therefrom on the inside thereof so as to span a side portion thereof and another end wall between the shell and the adjacent cylindrical portion of the housing defining the hidden cavity therebehind; and means defining an inwardly movable wall portion of said shell defining a door to gain access to the cavity defined between the shell and the adjacent portion of the cylindrical housing.

2. The hat of claim 1 wherein the inside of said cylindrical housing and the opposing face of said shell have a plurality of generally parallel longitudinal recesses defining ribs therebetween, one of the longitudinal recesses being disposed at each of the two junctures between the shell and the housing to hide the seams therebetween.

3. The hat of claim 2 wherein at least one of the ribs extending longitudinally of said shell comprises said inwardly movable door to gain access to the cavity between the shell and the adjacent portion of the housing.

4. The hat of claim 1 wherein said other end wall comprises an arcuate, radially extending brim about the periphery of the cylindrical housing, the brim being somewhat wider in the area above said cavity so as to cover one end of the cavity to facilitate concealing the same.

5. A hat comprising:

a generally cylindrical housing defining the main body of the hat and having a substantially flat end wall closing one end of the cylindrical housing;

a second wall spaced inwardly from said end wall and spanning the interior of said cylindrical housing defining a false bottom for the hat;

a hinged door in said second wall movable between a closed position substantially flush with said second wall and pivotal to an open position providing access therethrough; and a closed frame means defining a separate compartment mounted to said second wall and said end wall within said false bottom behind said hinged door.

6. The hat of claim 5 wherein said door is pivotally mounted to said second wall on an axis intermediate ends of the door so that the door can be pivoted by a user of the magic hat by depressing on the door on one side of said axis.

7. A hat comprising:

a generally cylindrical housing defining the main body of the hat and having an end wall closing one end of the cylindrical housing;

a second wall spaced inwardly from said end wall and spanning the interior of said cylindrical housing defining a substantially closed cavity therebetween;

means defining a passage at one side of said second wall for the flow of fluid material therethrough to the cavity defined between said end wall and said second wall; baffle means in said cavity adjacent said passage means to hold the fluid material in said false bottom when a user rotates the hat to an upside down position in an arc wherein said passage means moves in an upward direction; and a longitudinally extending arcuate shell disposed within said cylindrical housing at the side thereof adjacent said passage means, the shell being of a larger diameter than said cylindrical housing and defining a second cavity therebetween and means closing said second cavity to hide said passage means, and terminating in a spaced relationship from said second wall adjacent said passage means to permit the fluid material to pass thereunder into said passage means and then into said cavity.

8. The hat of claim 7 including frame means connected to said second wall defining a separate water-tight compartment within said cavity beneath said second wall, and door means in said second wall movable between closed and open positions to gain access to said water-tight compartment.

9. A magic hat illusion apparatus, comprising:

a generally cylindrical housing defining the main body of the hat and having an end wall closing one end of the cylindrical housing;

means defining a hidden arcuate compartment extending longitudinally about at least a portion of the inside of said housing;

means defining a radially extending arcuate brim about the open end of said housing, the brim being somewhat wider in the area of said compartment to hide said compartment;

an actuatable magic trick disposed within said compartment;

actuating means having a portion exposed through said housing for actuation by a user of the magic hat to actuate said magic trick; and a hat band extending about the exterior of the housing adjacent the brim and covering said actuating means so as to hide the same.

10. The magic hat of claim 9 wherein said magic trick comprises a flexible fluid receiving reservoir which is deformable by depressing said actuating means, said reservoir being in communication with an aperture to the exterior of the magic hat to cause the fluid to be expelled through the aperture on deforming the flexible reservoir.

11. The magic hat of claim 10 wherein said aperture is disposed remote from said fluid reservoir, and including conduit means within said compartment between the fluid reservoir and the aperture for the passage of the fluid therethrough.

* * * * *